US005314756A

United States Patent [19]

Tagaya

[11] Patent Number: 5,314,756

[45] Date of Patent: May 24, 1994

[54] PERMANENT MAGNET OF RARE-EARTH-ELEMENT/TRANSITION-METAL SYSTEM HAVING IMPROVED CORROSION RESISTANCE AND MANUFACTURING METHOD THEREOF

[75] Inventor: Atsushi Tagaya, Kumagaya, Japan

[73] Assignee: Hitachi Metals, Ltd., Tokyo, Japan

[21] Appl. No.: 981,864

[22] Filed: Nov. 25, 1992

[30] Foreign Application Priority Data

Nov. 27, 1991 [JP] Japan ..... 03-337741

[51] Int. Cl.[5] ..... B22F 7/00

[52] U.S. Cl. ..... 428/548; 428/555; 428/554; 428/553; 428/548

[58] Field of Search ..... 148/302, 301; 156/154; 204/16, 20, 40, 56 R; 257/751; 419/12, 23, 27, 31; 428/613, 628, 667

[56] References Cited

U.S. PATENT DOCUMENTS

| | | | |
|---|---|---|---|
| 3,674,660 | 7/1972 | Lyde | 204/52 R |
| 3,877,478 | 4/1975 | Longworth | 137/94 |
| 4,082,620 | 4/1978 | Skurkiss | 204/15 |
| 4,959,273 | 9/1990 | Hammamura et al. | 428/548 |
| 4,984,226 | 1/1991 | Kobori | 369/13 |

FOREIGN PATENT DOCUMENTS

| | | |
|---|---|---|
| 53-0114737 | 3/1977 | Japan . |
| 53-0114738 | 3/1977 | Japan . |
| 56-0166398 | 12/1981 | Japan . |
| 57-0181395 | 11/1982 | Japan . |
| 59-46008 | 3/1984 | Japan . |
| 60-54406 | 3/1985 | Japan . |
| 62-236345 | 10/1987 | Japan . |
| 64-42805 | 2/1989 | Japan . |
| 1-0286407 | 11/1989 | Japan . |
| 1320373 | 6/1973 | United Kingdom . |
| 1327376 | 8/1973 | United Kingdom . |

*Primary Examiner*—Donald P. Walsh
*Assistant Examiner*—John N. Greaves
*Attorney, Agent, or Firm*—Sughrue, Mion, Zinn, Macpeak & Seas

[57] ABSTRACT

Disclosed is to improve corrosion resistance of rare-earth-element (RE)/transition-metal system permanent magnets by means of surface treatment, the magnets containing one or more of RE comprising yttrium, transition metals mainly comprising Fe. A conductive underlayer is formed on the surface of the magnet, on which an electroplated (hereinafter referred to as e-) Cu layer with the average crystal grain size not larger than 0.9 μm is further formed. The underlayer may be any of an e-Ni layer, an electroless-plated Cu layer, an e-Cu layer by a cyanic Cu bath and another e-Cu layer by a bath of an alkaline organic acid salt of Cu containing phosphoric ester as a primary ingredient. A protective layer may be formed on the e-Cu layer, which is any of an e-Ni layer, an electroless-plated Ni-P layer, an e-Ni-alloy layer. The e-Cu layer is formed with a Cu pyrophosphate bath.

16 Claims, 10 Drawing Sheets

PERMANENT MAGNET OF RARE-EARTH-ELEMENT/TRANSITION-METAL SYSTEM HAVING IMPROVED CORROSION RESISTANCE AND MANUFACTURING METHOD THEREOF

BACKGROUND OF THE INVENTION

The present invention relates to a permanent magnet of R-TM-B system in which an electroplated copper layer having a fine crystal grain size is provided on a magnetic body to remarkably improve corrosion resistance property.

With higher performance and smaller size of electric and electronic equipment, similar demands have become increasingly great for permanent magnets used as parts of those equipment. More specifically, while the permanent magnet which seemed to be strongest in the past was made of rare-earth-element/cobalt (R-Co) system, a stronger permanent magnet of R-TM-B system has been recently put into practice (see JP-A-59-46008). Herein, R is one or more of rare earth elements including Y (yttrium), and TM is one or more of transition metals including typical elements of Fe and Co, a part of which may be replaced by any other metal element or nonmetal element. B is boron.

However, such a permanent magnet of R-TM-B system has suffered from the problem that the magnet is very likely to corrode. For this reason, it has been proposed to provide an oxidation-resistant protective layer on the surface of a permanent magnet body for improving corrosion resistance.

The proposed types of protective layer include an electroplated nickel layer, an oxidation-resistant resin layer, an aluminum ion-plated layer, and so forth. Above all, the nickel electroplating has drawn an attention because it is simple treatment and effective in improving corrosion resistance of the permanent magnet of R-TM-B system (see JP-A-60-54406). As compared with the method of using oxidation-resistant resin, the nickel electroplating is advantageous in that the resulting surface protective layer is excellent in mechanical strength and the layer will not in itself appreciably absorb humidity.

The nickel electroplating method, however, has a tendency that since the plating current is liable to concentrate on outer peripheral portions, such as corners, of the magnet body, the film thickness becomes relatively thick in those outer peripheral portions, while since the plating current is hard to pass through an inner hole and inner peripheral portions, the film thickness becomes relatively thin in those inner hole and inner peripheral portions. Accordingly, a sufficient degree of uniformity in the film thickness cannot be achieved by the nickel electroplating alone. For those magnets having a peculiar shape such as cylindrical magnets, in particular, there has arisen a problem that the electroplated nickel layer is hardly coated on the inner peripheral portions.

To solve the above problem of undesired uniformity in the film thickness, a method of providing an electroplated copper layer as an underlayer for the nickel electroplating has been proposed so far (see JP-A-62-236345 and JP-A-64-42805, for example).

A plating bath which can be used in practice includes a cyanic copper bath and an alkaline organic acid salt of copper bath containing phosphoric ester as a primary ingredient. These baths are advantageous in that plating can be directly applied onto the surface of the permanent magnet of R-TM-B system, because they have no substitution action of copper.

The term "substitution action" used herein implies that when some metal at a lower-level position in the electrochemical series is immersed in a salt solution of another metal at a higher-level position in the electrochemical series than the above metal, the immersed metal is dissolved and the metal in the solution is instead reduced from an ionized state so that it is deposited to form a coating. For example, those metals which are at higher-level positions than neodymium and iron in the electrochemical series include chromium, 18-8 stainless steel (in activated state), lead tin, nickel (in activated state), brass, copper, bronze, Cu-Ni alloy, nickel (in passive state), 18-8 stainless steel (in passive state), silver, gold, platina, etc. Any appropriate one of those metals has been selected depending on demand.

Also, bright plating has been conventionally used for the reason that pin holes are few and corrosion resistance is superior. The term "bright" used herein means a state that the surface has microscopic smoothness. To obtain a bright surface, it has been conventionally practiced to select an optimum brightener in view of such factors as residual stress and hardness of the coating, or to slowly effect an electrolytic reaction with the so-called bright current density.

Regardless of whether being electrolytic or nonelectrolytic, however, the conventional copper plating has a disadvantage that the plated layer is easy to change color in air and is likely to cause surface oxidation. In other words, the electroplated nickel layer provided on the plated copper layer is a coating which is indispensable in maintaining corrosion resistance. But, the electroplated copper layer resulted from using a cyanic copper bath and the alkaline organic acid salt-of-copper bath containing phosphoric ester as a primary ingredient is formed as a film which has the surface configuration of a cellar structure that includes almost circular cells having the size of 10 to 50 μm as shown in a photograph of FIG. 13, and also has somewhat rough structure with the crystal grain size of 0.5 to 2 μm as shown in a photograph of FIG. 14. Particularly, in FIG. 14, there appears a sharp crack extending laterally from the upper left portion. Note that the photographs were taken at 500 magnifications for FIG. 13 and 10,000 magnifications for FIG. 14.

Thus, since the plated copper layer is formed as a film of cellar structure having such surface roughness, even if the plated nickel layer is coated on the plated copper underlayer, the resulting film is formed to exhibit the surface configuration of cellar structure having the surface roughness of 1 to 5 μm as shown in a photograph of FIG. 15. This has raised the problem that pin holes remain in the plated nickel layer at the boundary portion of cellar structure and corrosion resistance is deteriorated. An attempt of avoiding a detrimental effect of the pin holes in the above case leads to another problem that the film thickness must be increased. In this connection, a laser microscope is to measure unevenness of the surface while scanning a laser beam at a location indicated by the center line in FIG. 15. Referring to FIG. 15, the uneven profile curve is present between an upper broken line, as a base, representing zero μm and a lower broken line representing 5.28 μm. The average depth (DEPTH) is also indicated by an arithmetic unit incorporated in the laser microscope. In the case of FIG. 15, DEPTH is 4.72 μm.

Further, the bright plating has suffered from the problem that an optimum brightener must be selected depending on cases, or that such a range of bright current density as expending an inconvenient amount of time must be selected at the sacrifice of productivity. Additionally, because brighteners contain sulfur (S), there is another problem that if due consideration is not paid to the relationship between a brightener used and an underlying or overlying layer, an electrochemical local battery may be formed to reduce corrosion resistance against the intention.

SUMMARY OF THE INVENTION

Accordingly, an object of the present invention is to provide a permanent magnet of R-TM-B system which is simple in structure, is highly reliable, and has improved corrosion resistance.

The inventor has found that the above object can be achieved by a magnet which is manufactured by applying a conductive underlayer and then coating an electroplated copper layer with a copper pyrophosphate bath. Details are as follows.

Even if the plating thickness is on the order of 5 μm, i.e., even if it is not so thick as required conventionally, the copper layer electroplated with the copper pyrophosphate bath is formed as a film which has the surface free of any cellar structure and superior in smoothness, and which has fine structure with the crystal grain size not larger than 0.9 μm as shown in a photograph of FIG. 11 (taken at 10,000 magnifications). Therefore, an electroplated nickel layer applied on the plated copper underlayer is also formed as a film having the surface superior in smoothness with the surface roughness not larger than 1 μm as shown in a photograph of FIG. 12. It is thus believed that the number of pin holes in the plated nickel film is remarkably reduced with the effect of such superior smoothness. The term "surface roughness" used herein means a depth of recess between a peak and an adjacent peak of surface undulations observed when a laser microscope scans over a region of predetermined length by a laser beam. The surface roughness is measured using a numeral value usually obtained as DEPTH by the laser microscope. As compared with DEPTH of 4.72 μm in the foregoing prior art shown in FIG. 15, DEPTH in FIG. 12 is 0.48 μm, meaning that the surface roughness of the present film is quite small.

As explained above, the present invention is to improve corrosion resistance of a permanent magnet of iron/rare-earth-elements system, e.g., a permanent magnet of R-TM-B system, which has been problematic so far in corrosion resistance, by coating the electroplated copper layer with the copper pyrophosphate bath. In the present invention, by the plating with the copper pyrophosphate bath, the plated layer having the smooth surface can be obtained without adding any brightener. Depending on applications, a brightener such as mercaptothiazole may be used in combination with the copper plating.

The film resulted from the plating with the copper pyrophosphate bath of the present invention is superior in electric conductivity, flexibility, malleability and ductility, and has a good degree of step coverage. The term "step coverage" used herein implies an ability of the plated film covering the underlayer. For instance, that term stands for an ability of the plated film depositing over those portions where the current density tends to lower, such as deep recesses of a sintered permanent magnet or the inner surface of a cylindrical magnet.

The current density for the plating with the copper pyrophosphate bath is preferably in a range of 1 to 5 A/dm$^2$. Also, the film thickness of the plated copper layer should be in a range of 2 to 20 μm, preferably in a range of 10 to 15 μm.

Before applying the electroplated copper layer with the copper pyrophosphate bath, a protective layer for the conductive underlayer is coated. The reason is in that because the copper pyrophosphate bath has a substitution action of copper unlike a cyanic copper bath and a bath of an alkaline organic acid salt of copper containing phosphoric ester as a primary ingredient, if a permanent magnet of R-TM-B system is directly immersed in the copper pyrophosphate bath, a copper film, which is quite thin and has poor adhesion between the plated film and the magnet surface, would be formed by substitution plating on the magnet surface. It is therefore required to provide, as a protective film, the underlayer comprising a metal film and prevent the occurrence of substitution plating for improving the adhesion. Incidentally, where the adhesion is poor, no diffusion layer is observed at the boundary with the underlying surface of the permanent magnet.

The kinds of metal films usable as the underlayer are preferably formed by nickel electroplating which enables direct plating on the surface of the permanent magnet of R-TM-B system, copper electroless plating, copper electroplating with a cyanic copper bath, and copper electroplating with a bath of an alkaline organic acid salt of copper bath containing phosphoric ester as a primary ingredient. Above all, the nickel electroplating is preferable because the plating bath is superior in stability. The nickel electroplating may be performed using any of a watt bath, a sulfamic acid bath and an ammono bath, and the preferable current density is in a range of 1 to 10 A/dm$^2$. Also, the film thickness of the underlayer is preferably in a range of 0.1 to 10 μm.

The underlayer is not necessarily formed of a metal and may be, for instance, an organic metal film, conductive plastics or conductive ceramics other than metals so long as it is in the form of a film having conductivity and shows good adhesion in plating with respect to the surface of the permanent magnet. The reason of requiring conductivity is because a plated copper layer is laminated on the underlayer by electroplating.

The above condition that adhesion between the underlayer and the surface of the permanent magnet is good means an electrochemical requirement that an ingredient of the underlayer is lower in ionization tendency than iron and rare earth elements which are primary component elements of the permanent magnet of iron/rare-earth-element system.

A protective layer may be further provided over the copper layer electroplated with the copper pyrophosphate bath.

As such a protective layer, any of an electroplated nickel layer, an electroless-plated Ni-P layer, and an electroplated nickel alloy layer is effective. The nickel electroplating may be performed using any of a watt bath, a sulfamic acid bath and an ammono bath, and the preferable current density is in a range of 1 to 5 A/dm$^2$. The film thickness of the plated nickel layer should be in a range of 2 to 20 μm, preferably in a range of 5 to 10 μm. Alternatively, the electroless-plated Ni-P layer or the electroplated nickel alloy layer such as Ni-Co, Ni-Fe and Ni-P may be coated. In this case, too, the film thickness of the metallic protective layer over the plated copper layer should be in a range of 2 to 20 μm, preferably in a range of 5 to 10 μm.

The appropriate total thickness of the plated layers is in a range of 10 to 25 μm.

Other than the foregoing, the protective layer in the present invention may be of a compound coating such as formed by metal clad, iron oxide, and oxide of a rare earth element. Further, the layer surface may be degenerated by irradiation of electron beams. In addition, there may provided a protective coating made of inorganic materials (glass, chromate, silica, nitride, carbide, boride, oxide or plasma polymer film, tanning film, blacking dyeing, diamond coating, and phosphoric acid treated film), or organic materials (resin layer kneaded with metallic powder, metal matrix containing glass, resin film, PPX, carbonic acid, metal soap, ammonium salt, amine, organo-silicic compound, and electropainting).

The permanent magnet of iron/rare-earth-elements system usable in the present invention includes a magnet of R-TM-B system where R (which is one or more of rare earth elements including yttrium) ranges from 5 to 40 wt. %, TM (which is one or more of transition metals including iron) ranges from 50 to 90 wt. %, and B (boron) ranges from 0.2 to 8 wt. %, a magnet of iron/rare-earth-element/nitrogen system, a magnet of iron/rare-earth-element/carbon system, etc.

In the case of using the permanent magnet of R-TM-B system in the present invention, for instance, a part of TM comprising Fe, Co, Ni, etc. can be replaced by such elements as Ga, Al, Ti, V, Cr, Mn, Zr, Hf, Nb, Ta, Mo, Ge, Sb, Sn, Bi and Ni depending on the purpose of addition. The present invention is applicable to any magnets of R-TM-B system. Additionally, the manufacture method may be any of a sintering method, a molten material rapidly cooling method, or modified methods of the former.

In pretreatment, an acid solution is preferably used to remove the degenerated layer through treatment and improve activation before the plating. Although strong acids such as sulfuric acid and hydrochloric acid are effective for the pretreatment, it is most desired to carry out the pretreatment in two steps; first etching with nitric acid of 2 to 10 Vol. % and second etching with a mixed acid of hydrogen peroxide of 5 to 10 Vol. % and acetic acid of 10 to 30 vol. %. After that the underlayer formed of a metallic film is coated.

BRIEF DESCRIPTION OF THE ATTACHED DRAWINGS

DETAILED DESCRIPTION OF THE PREFERRED EMBODIMENT

Experiment 1

Figure 1:
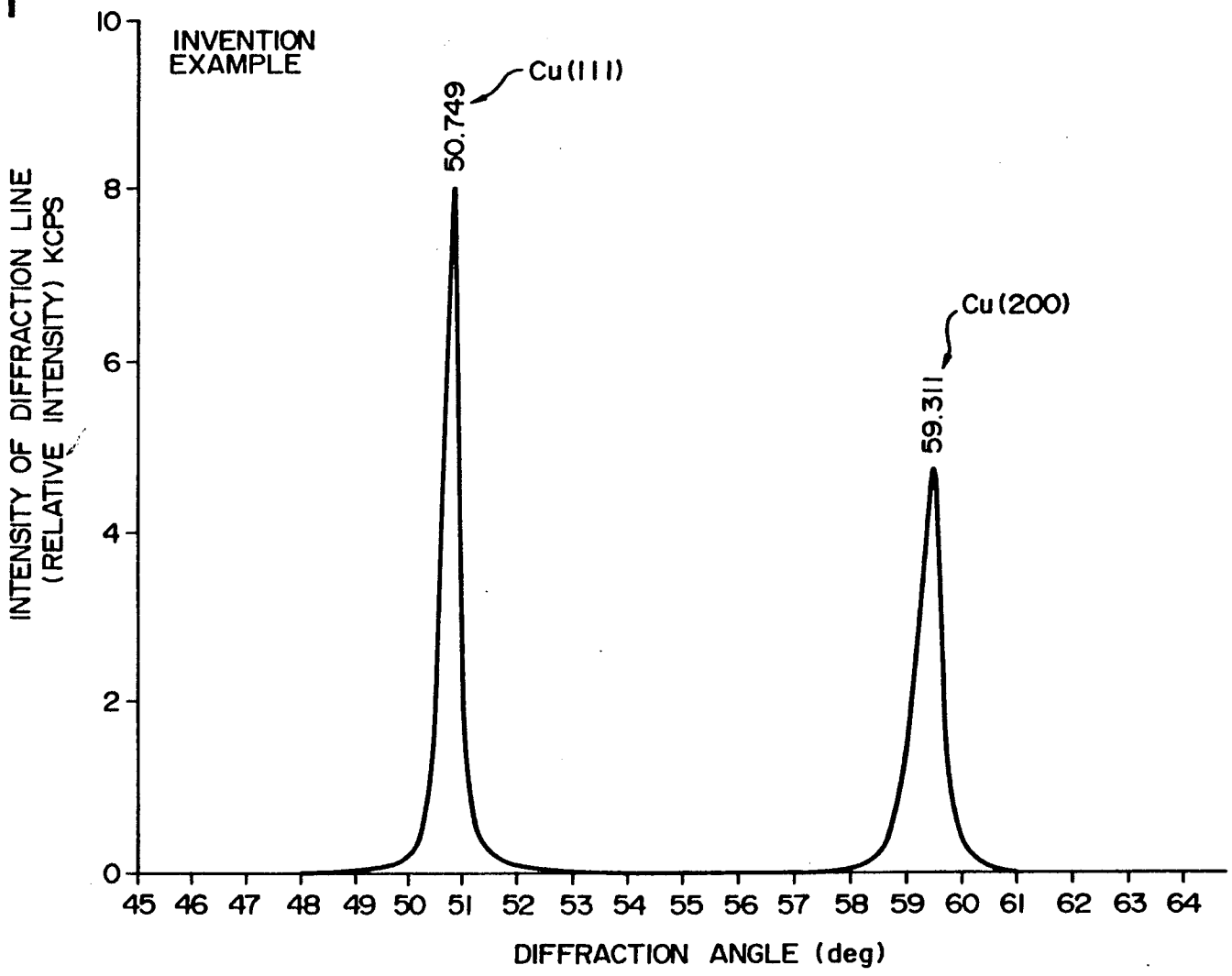
FIG. 1 is a chart showing an X-ray diffraction pattern of a plated copper layer according to the present invention.

An alloy with composition of $Nd(Fe_{0.7}CO_{0.2}B_{0.07}Ga0.03)_{6.5}$ was fabricated by arc melting, and an obtained ingot was roughly pulverized by a stamp mill and a disk mill. Fine pulverization was then performed by a jet mill using nitrogen gas as a pulverizing medium to obtain fine powder with the grain size of 3.5 μm (FSSS).

The obtained material powder was press-formed under a transverse magnetic field of 15 KOe. The forming pressure was 2 tons /cm$^2$. A resulting formed product was sintered in vacuum under conditions of 1090° C. for 2 hours. A sintered produce was cut into pieces each having dimensions of 18×10×6 mm. Each piece was kept being heated in an argon atmosphere of 900° C. for 2 hours and, after rapid cooling, it was kept in an argon atmosphere held at a temperature of 600° C. for 1 hour.

A sample thus obtained was subjected, as pretreatment, to first etching with nitric acid of 5 vol. % and then second etching with a mixed acid of hydrogen peroxide of 10 vol. % and acetic acid of 25 vol. %. After that various kinds of surface treatment were applied under working conditions shown in Table 1 below so that the plated layer had a thickness given by a value also shown in Table 1.

TABLE 1

| Sample No. | Surface Treatment | Thickness of Plated Layer |
|---|---|---|
| Example of the Invention | | |
| 1 | | |
| a. | Ni electroplating with watt bath and washing with water | Ni plating as underlayer 1 μm |
| b. | Cu electroplating with Cu pyrophosphate bath and washing with water | Cu plating 5 μm |
| c. | Ni electroplating with watt bath and washing with water, followed by drying at 100° C. for 5 minutes | Ni plating 5 μm Total 10 μm |
| Comparative Examples | | |
| 2 | | |
| a. | Ni electroplating with watt bath and washing with water, followed by drying at 100° C. for 5 minutes | Ni plating 10 μm |
| 3 | | |
| a. | electroplating with a bath of alkaline organic acid salt of Cu containing phosphoric ester as primary ingredient, and washing with water | Cu plating 5 μm |
| b. | Ni electroplating with watt bath and washing with water, followed by drying at 100° C. for 5 minutes | Ni plating 5 μm Total 10 μm |
| 4 | | |
| a. | Cu electroplating with Cu pyrophosphate bath and washing with water | Cu plating 5 μm |
| b. | Ni electroplating with watt bath and washing with water, followed by drying at 100° C. for 5 minutes | Ni plating 5 μm Total 10 μm |

The samples in Table 1 were subjected to a damp resistance test at 80° C., 90% RH for 500 hours and a salt spray test with 5% NaCl at 35° C. for 100 hours. The results are shown in Table 2 below. It should be noted that the plated copper layer in the example of the present invention had the average crystal grain size of 0.5 μm and surface roughness of the plated nickel surface was 0.5 μm.

TABLE 2

| Sample No. | Damp Resistance Test (80° C., 90% RH) | Salt Spray Test (35° C., 5% NaCl) |
|---|---|---|
| 1* | No changes for 500 hr | 80 hr |
| ** | | |
| 2 | Spot rust locally occurred at 300 hr | 30 hr |
| 3 | Spot rust locally occurred at 200 hr | 20 hr |
| 4 | Film was entirely peeled off at 100 hr | 5 hr |

*Example of the invention
**Comparative Example

In Table 2, the results of the damp resistance test indicate changes in sample appearance and the results of the salt spray test indicate the time at which red rust has occurred.

It will be found from Table 2 that the permanent magnet according to the present invention is remarkably improved in corrosion resistance as compared with the prior art magnets.

Figure 2:
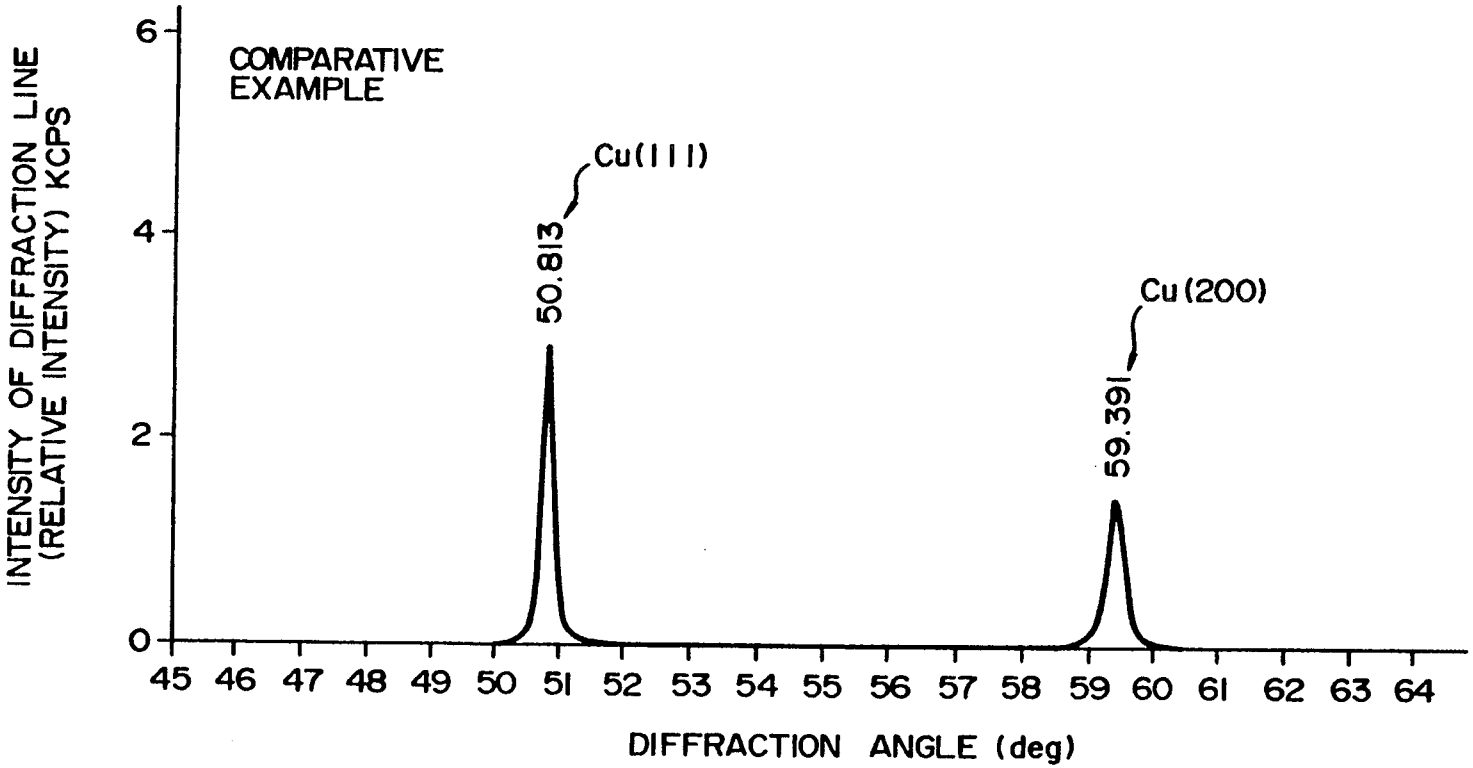
FIG. 2 is a art showing an X-ray diffraction pattern of a comparative example.
Figure 3:
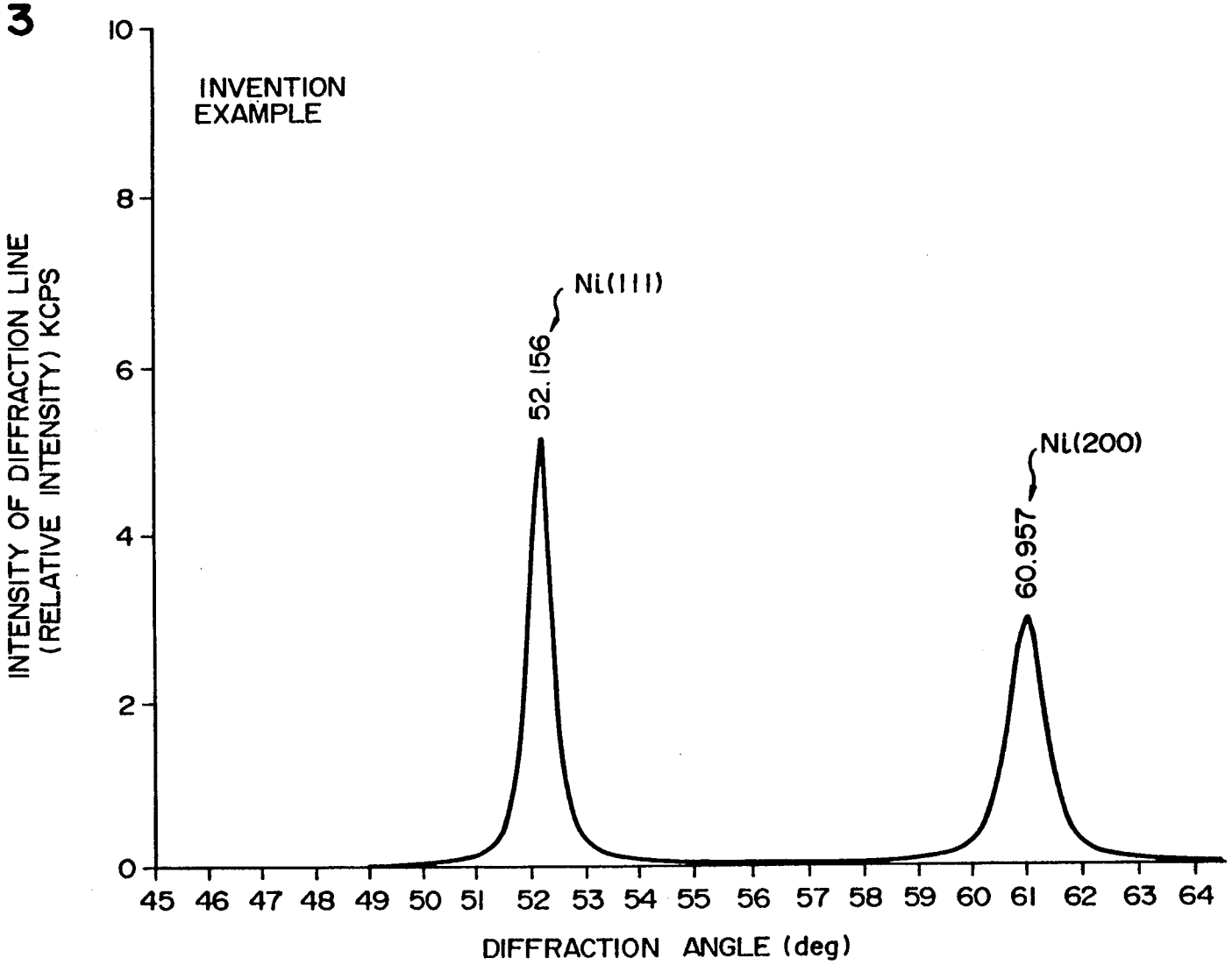
FIG. 3 is a chart showing an X-ray diffraction pattern of a plated nickel film resulted from further plating nickel on the plated copper layer according to the present invention.
Figure 4:
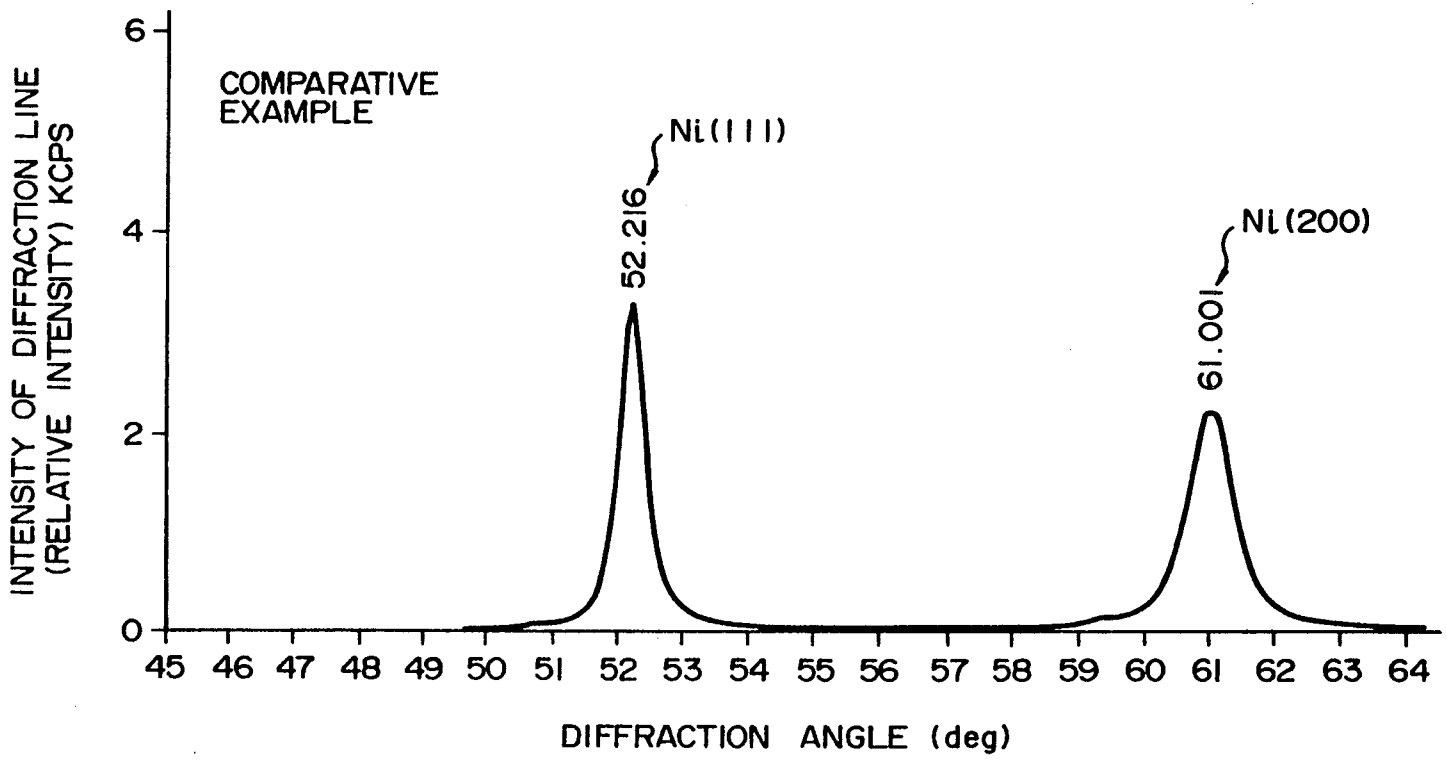
FIG. 4 is a chart showing an X-ray diffraction pattern of a comparative example.

FIGS. 1 and 3 are charts showing X-ray diffraction patterns of the plated layers according to the present invention, while FIGS. 2 and 4 are charts showing X-ray diffraction patterns of the plated layers as comparative examples. FIGS. 1 and 3 are compared with FIGS. 2 and 4, respectively. More specifically, FIG. 1 shows an X-ray diffraction pattern of the plated copper layer resulted from the electroplating with the copper pyrophosphate bath according to the present invention, and FIG. 2 shows, as a comparative example, an X-ray diffraction pattern of the copper film electroplated with the bath of alkaline organic acid salt of copper containing phosphoric ester as a primary ingredient.

It will be found from FIG. 1 that the X-ray diffraction intensity of the film formed according to the present invention is sharp and great. This means that the film obtained by the present invention is a dense plated film having crystal structure which has grown homogeneously in one direction.

Likewise, FIG. 3 shows an X-ray diffraction pattern of the plated nickel film resulted from further electroplating nickel on the copper layer electroplated with the copper pyrophosphate bath according to the present invention, and FIG. 4 shows, as a comparative example, an X-ray diffraction pattern of the plated nickel film resulted from further electroplating nickel over the copper layer electroplated with the bath of alkaline organic acid salt of copper containing phosphoric ester as a primary ingredient. It will be found from FIG. 3 that the X-ray diffraction intensity of the film formed according to the present invention is sharp and great. This means that the film obtained by the present invention is a dense plated film having crystal structure which has grown homogeneously in one direction. This is believed to be resulted from that the copper underlayer plated with the copper pyrophosphate bath is homogeneously grown in one direction as stated above and, therefore, the overlying nickel layer also grows following the underlayer.

Experiment 2

As with Experiment 1, permanent magnets were fabricated under conditions shown in Table 3 hereinafter; sample 1 plated according to the present invention (i.e., resulted from applying a nickel underlayer by striking plating over the surface of the Nd-Fe-B magnet and then a copper layer plated with the copper pyrophosphate bath), sample 2 resulted from electroplating a copper layer with a bath of an alkaline organic acid salt of copper containing phosphoric ester as a primary ingredient on the surface of the Nd-Fe-B magnet, followed by washing with water, and sample 3 resulted from plating a copper layer with the copper pyrophosphate bath directly over the surface of the Nd-Fe-B magnet the striking plating of nickel, the samples 2 and 3 being comparative examples. Then, the plated layers of those samples were observed in section by a scan type electron microscope. Photographs of FIGS. 5, 7 and 9 were taken at 1,000 magnifications and photographs of FIGS. 6, 8 and 10 were taken at 3,000 magnifications.

Figure 5:
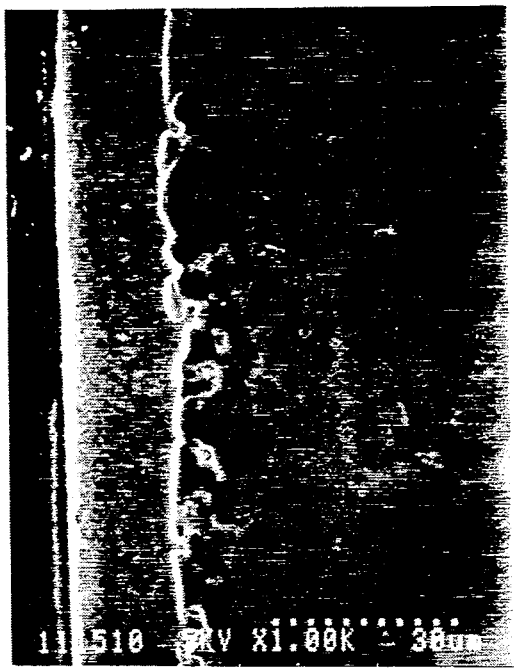
FIG. 5 is a photograph showing metal structure in section of a film resulted from two steps of nickel striking plating and then copper electroplating with a copper pyrophosphate bath according to the present invention, taken by a scan type electron microscope at 1,000 magnifications.
Figure 6:
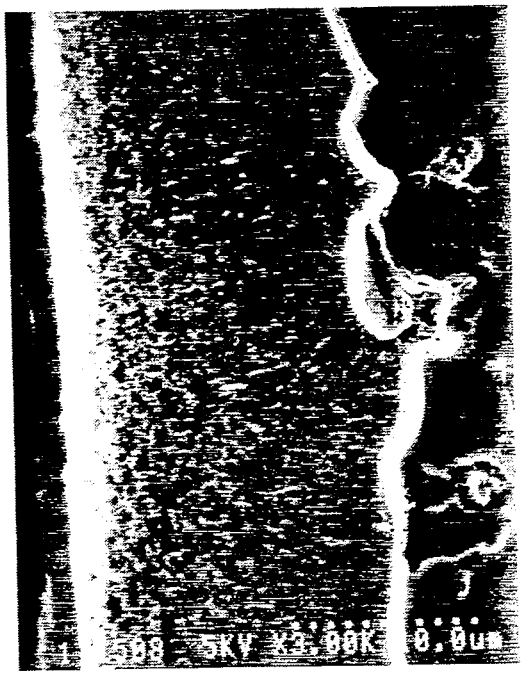
FIG. 6 is a photograph similar to FIG. 5, but taken at 3,000 magnifications.
Figure 7:
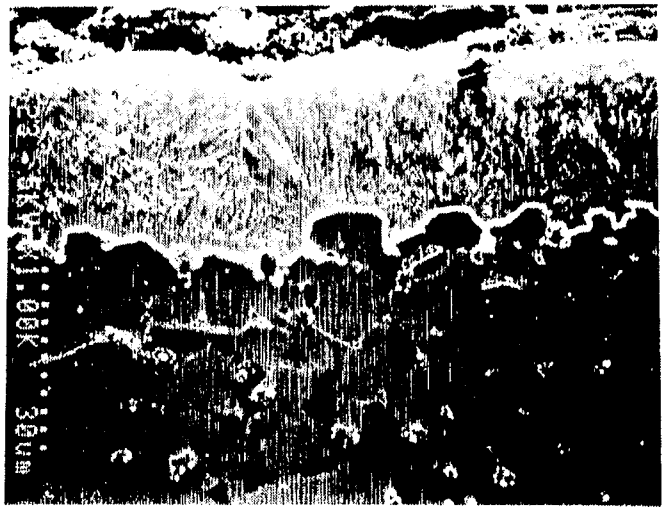
FIG. 7 is a photograph showing, as a comparative example, metal structure in section of a film resulted from one step of direct copper electroplating with a copper pyrophosphate bath, taken by a scan type electron microscope at 1,000 magnifications.
Figure 8:
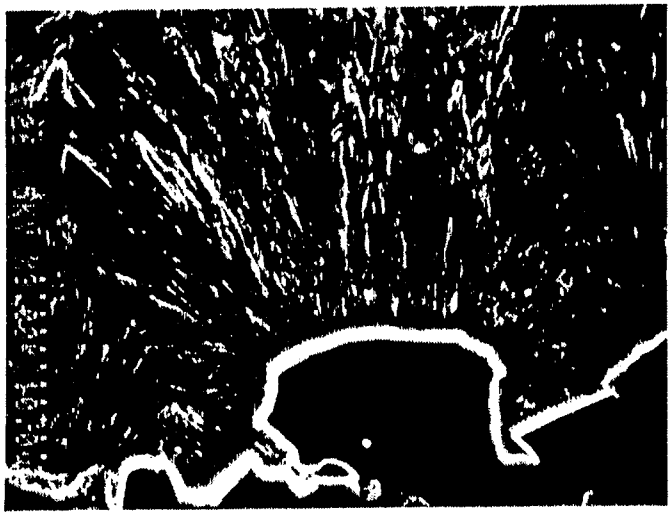
FIG. 8 is a photograph similar to FIG. 7, but taken at 3,000 magnifications.
Figure 9:
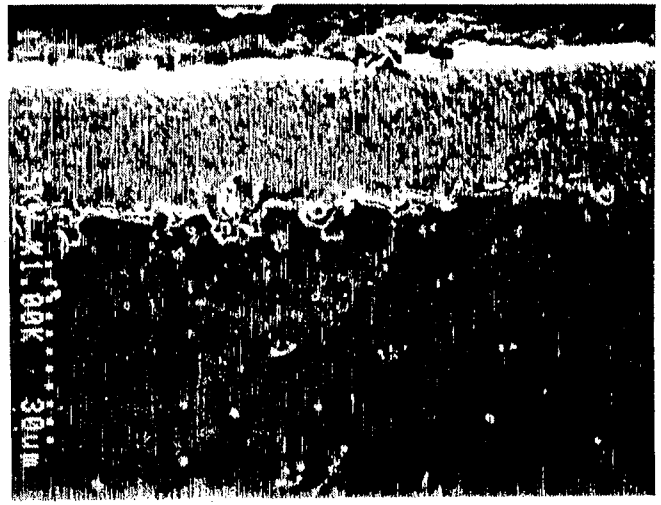
FIG. 9 is a photograph showing, as a comparative example, metal structure in section of a film resulted from two steps of nickel striking plating and then copper electroplating with a bath of an alkaline organic acid salt of copper containing phosphoric ester as a primary ingredient, taken by a scan type electron microscope at 1,000 magnifications.
Figure 10:
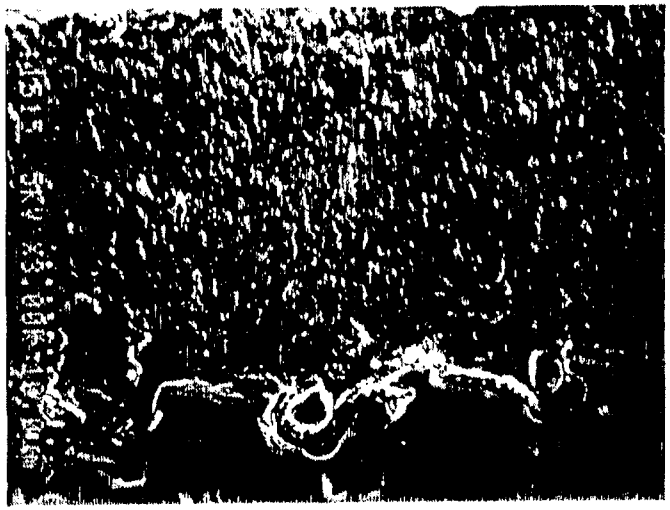
FIG. 10 is a photograph similar to FIG. 9, but taken at 3,000 magnifications.
Figure 11:
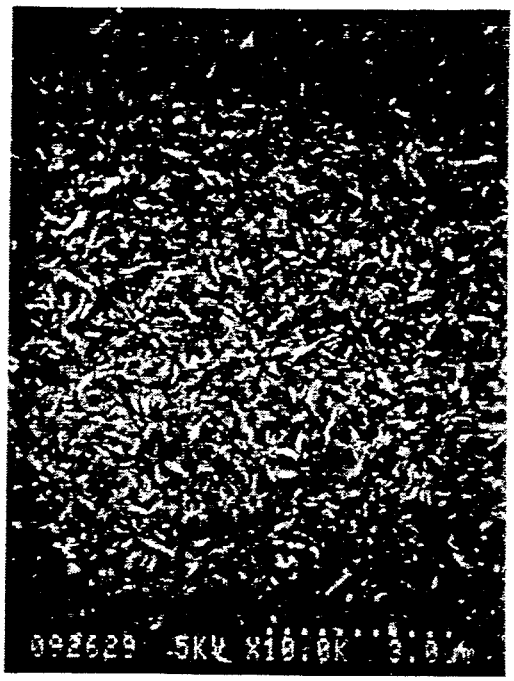
FIG. 11 is a photograph showing metal structure of the surface of a copper layer electroplated with a copper pyrophosphate bath according to the present invention, taken by a scan type electron microscope.
Figure 12:
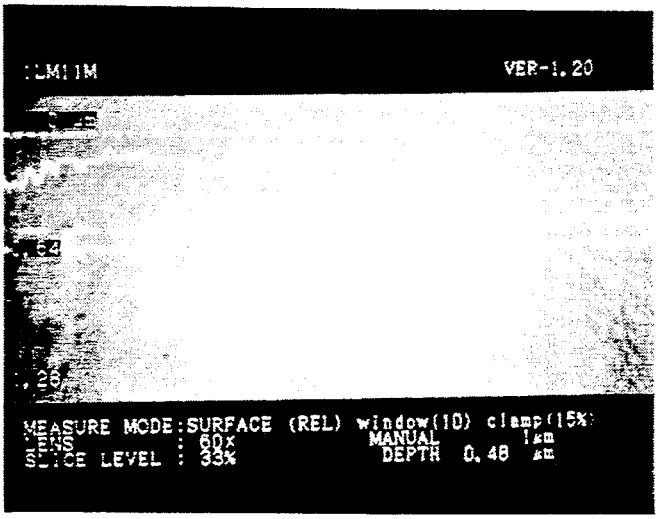
FIG. 12 is a photograph showing metal structure of the surface of an electroplated nickel layer which is coated on the copper layer electroplated with the copper pyrophosphate bath according to the present invention, taken by a laser microscope.
Figure 13:
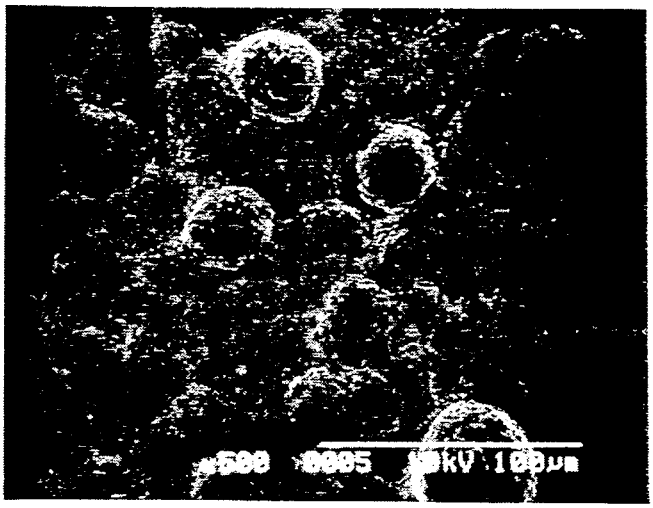
FIG. 13 is a photograph showing, as a comparative example, the surface of a copper layer electroplated with a bath of an alkaline organic acid salt of copper containing phosphoric ester as a primary ingredient, taken by a scan type electron microscope at 500 magnifications.
Figure 14:
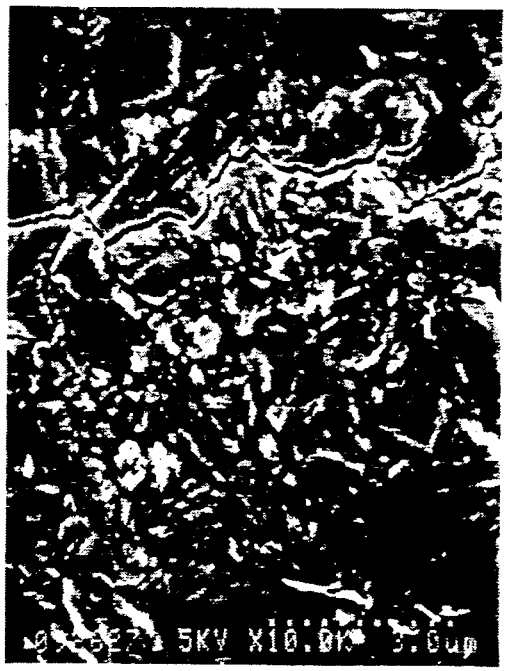
FIG. 14 is a photograph showing, as a comparative example, the surface of a copper layer electroplated with a bath of an alkaline organic acid salt of copper containing phosphoric ester as a primary ingredient, taken by a scan type electron microscope at 10,000 magnification.
Figure 15:
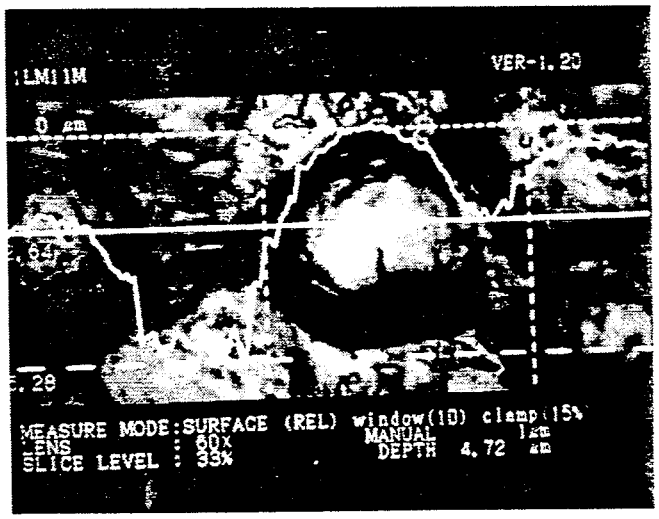
FIG. 15 is a photograph showing, as a comparative example, the surface of an electroplated nickel layer which is coated on the copper layer electroplated with the bath of the alkaline organic acid salt of copper containing phosphoric ester as a primary ingredient, taken by a laser microscope.

FIGS. 5 and 6 show the plated layer according to the present invention. It will be found from these photographs that the present plated layer is dense with the average crystal grain size of 0.5 μm and develops crystal growth uniform in one direction. In contrast, it will be found from FIGS. 7 and 8 showing the comparative example that rough columnar crystals with the average crystal grain size of 2.0 μm are individually grown in different or separate directions perpendicular to surface grains of the Nd-Fe-B magnet so that they collide with each other to define boundary interfaces. These boundary interfaces cause double- or triple-folded points on the layer surface and produce defects such as pin holes which are responsible for deteriorating corrosion resistance. Additionally, internal stresses remain in those boundary interfaces. Any way, it is apparent that the presence of such boundary interfaces is not desired from the standpoint of corrosion resistance. The comparative example shown in FIGS. 9 and 10 represents the case which includes the copper layer by the plating with the copper pyrophosphate bath adapted to provide fine crystal grains in itself, but includes no nickel layer by the striking plating as a conductive underlayer. In an upper layer of the underlying Nd-Fe-B magnet, there irregularly appear smuts caused from the absence of substitution plating. Those smuts look like holes. It seems that those defects are attributable to partial slip-off of the plated film in the grinding step required to fabricate the sectioned sample because of weak adhesion. As will be seen, although much improved in comparison with the comparative example of FIGS. 7 and 8, relatively rough crystals with the average crystal grain size of 2.0 μm are grown as a result of plating the copper layer with the copper pyrophosphate bath directly over the underlying magnet surface.

Further, observing an X-ray diffraction pattern like FIGS. 1 through 4, the pattern having the sharp peak intensity of copper was observed for the plated layer of FIGS. 5, 6 according to the present invention. This supports the fact that columnar copper crystals which are quite superior in orientation can be produced by such a plating step of the present invention as to plate the copper layer with the copper pyrophosphate bath over the appropriate conductive layer.

TABLE 3

| Sample No. | Surface Treatment | Thickness of Plated Layer |
|---|---|---|
| 1* | | |
| a. | Ni electroplating with watt bath and washing with water | Ni plating as under-layer 1 μm |
| b. | Cu electroplating with Cu pyrophosphate bath and washing with water | Cu plating 19 μm Total 20 μm |
| 2** | Cu electroplating with a bath of alkaline organic acid salt of Cu containing phosphoric ester as primary ingredient, and washing with water | Cu plating 20 μm |
| 3** | Cu electroplating with Cu pyrophosphate bath and washing with water | Cu plating 20 μm |

*Example of the invention
**Comparative Example

Experiment 3

An alloy with similar composition to Experiment 1 was fabricated by arc melting, and an obtained ingot was roughly pulverized by a stamp mill and a disk mill. Fine pulverization was then performed by a jet mill using nitrogen gas as a pulverizing medium to obtain fine powder with the grain size of 3.5 μm (FSSS).

The obtained material powder was filled in a metallic die with dimensions of 9 mm outer diameter, 25 mm inner diameter and 15 mm height, oriented in the radial direction, and then press-formed under the forming pressure of 15 kg/mm$^2$, thereby obtaining a formed product. This formed product was sintered in vacuum under conditions of 1090° C. for 2 hours. A sintered Product was kept being heated in an argon atmosphere of 900° C. for 2 hours and, after rapid cooling, it wa5 kept in an argon atmosphere held at a to temperature of 600° C. Samples thus obtained were plated in a like manner to Experiment 1. In other words, various kinds of surface treatment were applied under working conditions shown in Table 4 hereinafter after by measuring the outer diameter of the cylindrical body with a micrometer, while changing plating conditions, so that the plated layer on the outer circumference of the cylindrical body had a thickness given by a value shown in Table 5, and then the plating conditions at that time. Table 6 shows a thickness of the plated layer on the platen inner circumference of the cylindrical body as resulted from the plating performed under the plating conditions thus determined. Sample numbers correspond to each other in Tables 4 through 6.

TABLE 4

| Sample No. | Surface Treatment |
|---|---|
| 1* | |
| a. | Ni electroplating with watt bath and washing with water |
| b. | Cu electroplating with Cu pyrophosphate bath and washing with water |
| c. | Ni electroplating with watt bath, washing with water, and then drying at 100° C. for 5 minutes |
| 2** | |
| a. | Ni electroplating with watt bath, washing with water, and then drying at 100° C. for 5 minutes |
| 3** | |
| a. | Cu electroplating with alkaline organic acid salt-of-Cu bath containing phosphoric ester as primary ingredient, and washing with water |
| b. | Ni electroplating with watt bath, washing with water, and then drying at 100° C. for 5 minutes |
| 4** | |
| a. | Cu electroplating with Cu pyrophosphate bath and washing with water |
| b. | Ni electroplating with watt bath, washing with water, and then drying at 100° C. for 5 |

TABLE 4-continued

| Sample No. | Surface Treatment |
|---|---|
| | minutes |

*Example of the Invention
**Comparative Example

TABLE 5

| Sample No. | Thickness of Plated Layer on Outer Circumference of Cylindrical Body | | |
|---|---|---|---|
| 1* | Ni plating as underlayer | 8 μm | |
| | Cu plating | 14 μm | |
| | Ni plating | 4 μm | Total 20 μm |
| 2** | Ni plating | 20 μm | |
| 3** | Cu plating | 14 μm | |
| | Ni plating | 6 μm | Total 20 μm |
| 4** | Cu plating | 14 μm | |
| | Ni plating | 6 μm | Total 20 μm |

*Example of the Invention
**Comparative Example

TABLE 6

| Sample No. | Thickness of Plated Layer over Inner Circumference of Cylindrical Body | | |
|---|---|---|---|
| 1* | Ni plating as underlayer | 1 μm | |
| | Cu plating | 14 μm | |
| | Ni plating | 2 μm | Total 17 μm |
| 2** | Ni plating | 10 μm | |
| 3** | Cu plating | 14 μm | |
| | Ni plating | 3 μm | Total 17 μm |
| 4** | Cu plating | 14 μm | |
| | Ni plating | 3 μm | Total 17 μm |

*Example of the Invention
**Comparative Example

The samples shown in Tables 4 through 6 were subjected to a damp resistance test at 80° C., 90% RH for 500 hours and a slat spray test with 5% NaCl at 35° C. for 100 hours. The results are shown in Table 7.

TABLE 7

| Sample No. | Damp Resistance Test (80° C., 90% RH) | Salt Spray Test (35° C., 5% NaCl) |
|---|---|---|
| 1* | No changes for 500 hr | No changes for 100 hr |
| 2** | Spot rust locally commenced in 300 hr | 30 hr |
| 3** | Spot rust locally commenced in 200 hr | 20 hr |
| 4** | Film entirely peeled off in 100 hr | 5 hr |

*Example of the Invention
**Comparative Example

In Table 7, the results of the damp resistance test indicate changes in sample appearance and the results of the salt spray test indicate the time at which red rust has commenced.

It will be found from Table 7 that the permanent magnet according to the present invention, which has a cylindrical shape, is also remarkably improved in corrosion resistance as compared with the prior art magnets. This is of great significance in industrial applicability. Stated otherwise, because cylindrical magnets can be subjected to uniform plating in a satisfactory manner, it is possible to inexpensively provide highly reliable, thin plated layers required for rotary machines such as spindle motors and servo motors, linear motors such as voice coil motors (VCM), and so forth, without deteriorating magnetic characteristics. Experiment 4:

Similarly to Experiment 1, samples were tested under various combinations of plating conditions as shown in Tables 8 through 11.

TABLE 8

| Sample No. | Surface Treatment | Thickness of Plated Layer |
|---|---|---|
| 1* | | |
| a. | Ni electroplating with watt bath and washing with water | Ni plating 2 μm |
| b. | Cu electroplating with Cu pyrophosphate bath and washing with water | Cu plating 3 μm |
| c. | Ni electroplating with watt bath and washing with water, followed by drying at 100° C. for 5 minutes | Ni plating 5 μm Total 10 μm |
| 2* | | |
| a. | Ni electroplating with watt bath and washing with water | Ni plating 2 μm |
| b. | Cu electroplating with Cu pyrophosphate bath and washing with water | Cu plating 3 μm |
| c. | Ni electroplating with watt bath and washing with water, followed by drying at 100° C. for 5 minutes | Ni plating 15 μm Total 20 μm |
| 3* | | |
| a. | Ni electroplating with watt bath and washing with water | Ni plating 2 μm |
| b. | Cu electroplating with Cu pyrophosphate bath and washing with water | Cu plating 13 μm |
| c. | Ni electroplating with watt bath and washing with water, followed by drying at 100° C. for 5 minutes | Ni plating 5 μm Total 20 μm |
| 4* | | |
| a. | Ni electroplating with watt bath and washing with water | Ni plating 0.5 μm |
| b. | Cu electroplating with Cu pyrophosphate bath and washing with water | Cu plating 4.5 μm |
| c. | Ni electroplating with watt bath and washing with water, followed by drying at 100° C. for 5 minutes | Ni plating 5 μm Total 10 μm |
| 5* | | |
| a. | Ni electroplating with watt bath and washing with water | Ni plating 0.5 μm |
| b. | Cu electroplating with Cu pyrophosphate bath and washing with water | Cu plating 4.5 μm |
| c. | Ni electroplating with watt bath and washing with water, followed by drying at 100° C. for 5 minutes | Ni plating 15 μm Total 20 μm |

*Example of the Invention

TABLE 9

| Sample No. | Surface Treatment | Thickness of Plated Layer |
|---|---|---|
| 6* | | |
| a. | Ni electroplating with watt bath and washing with water | Ni plating 0.5 μm |
| b. | Cu electroplating with Cu pyrophosphate bath and washing with water | Cu plating 14.5 μm |
| c. | Ni electroplating with watt bath and washing with water, followed by drying at 100° C. for 5 minutes | Ni plating 5 μm Total 20 μm |
| 7* | | |
| a. | Cu electroless plating with nonelectrolytic Cu bath and washing with water | Cu plating 2 μm |
| b. | Cu electroplating with Cu pyrophosphate bath and washing with water | Cu plating 13 μm |

TABLE 9-continued

| Sample No. | Surface Treatment | Thickness of Plated Layer |
|---|---|---|
| c. | Ni electroplating with watt bath and washing with water, followed by drying at 100° C. for 5 minutes | Ni plating 5 μm Total 20 μm |
| 8* | | |
| a. | Ni electroplating with watt bath and washing with water | Ni plating 2 μm |
| b. | Cu electroplating with Cu pyrophosphate bath and washing with water | Cu plating 13 μm |
| c. | Ni—P electroless plating with nonelectrolytic Cu bath and washing with water, followed by drying at 100° C. for 5 minutes | Ni plating 5 μm Total 20 μm |
| 9* | | |
| a. | Ni electroplating with watt bath and washing in water | Ni plating 2 μm |
| b. | Cu electroplating with Cu pyrophosphate bath and washing in water | Cu plating 13 μm |
| c. | Electropainting with epoxy resin electrodeposition bath and washing in water, followed by baking at 200° C. for 1 hour | Epoxy resin layer 5 μm Total 20 μm |

*Example of the Invention

TABLE 10

| Sample No. | Surface Treatment | Thickness of Plated Layer |
|---|---|---|
| 10** | | |
| a. | Ni electroplating with watt bath and washing with water, followed by drying at 100° C. for 5 minutes | Ni plating 10 μm Total 10 μm |
| 11** | | |
| a. | Ni electroplating with watt bath and washing with water, followed by drying at 100° C. for 5 minutes | Ni plating 20 μm Total 20 μm |
| 12** | | |
| a. | Cu electroplating with alkaline organic acid salt-of-Cu bath containing phosphoric ester as primary ingredient, and washing with water | Cu plating 5 μm |
| b. | Ni electroplating with watt bath and washing with water, followed by drying at 100° C. for 5 minutes | Ni plating 5 μm Total 10 μm |
| 13** | | |
| a. | Cu electroplating with alkaline organic acid salt-of-Cu bath containing phosphoric ester as primary ingredient, and washing with water | Cu plating 5 μm |
| b. | Ni electroplating with watt bath and washing with water, followed by drying at 100° C. for 5 minutes | Ni plating 15 μm Total 20 μm |
| 14** | | |
| a. | Cu electroplating with alkaline organic acid salt-of-Cu bath containing phosphoric ester as primary ingredient, and washing with water | Cu plating 15 μm |
| b. | Ni electroplating with watt bath and washing with water, followed by drying at 100° C. for 5 minutes | Ni plating 5 μm Total 20 μm |

**Comparative Example

TABLE 11

| Sample No. | Surface Treatment | Thickness of Plated Layer |
|---|---|---|
| 15** | | |
| a. | Cu electroplating with Cu pyrophosphate bath and washing with water | Cu plating 5 μm |
| b. | Ni electroplating with watt bath and washing with water, followed by drying at 100° C. for 5 minutes | Ni plating 5 μm Total 10 μm |
| 16** | | |
| a. | Cu electroplating with Cu pyrophosphate bath and washing with water | Cu plating 5 μm |
| b. | Ni electroplating with watt bath and washing with water, followed by drying at 100° C. for 5 minutes | Ni plating 15 μm Total 20 μm |
| 17** | | |
| a. | Cu electroplating with Cu pyrophosphate bath and washing with water | Cu plating 15 μm |
| b. | Ni electroplating with watt bath and washing with water, followed by drying at 100° C. for 5 minutes | Ni plating 5 μm Total 20 μm |

**Comparative Example

The samples shown in Table 8 through 11 were subjected to a damp resistance test at 80° C., 90% RH for 1,000 hours, a salt spray test with 5% NaCl at 35° C. for hours, a steam press test (PCT) at 119.6° C., 100% RH and 2 atms for 100 hours, and further an adhesion strength test at the interface between the surface of the magnetic body and the plated film. The adhesion strength test was made in two ways; i.e., quantitative evaluation using a Sebastion I type adhesion tester manufactured by Quad Group Co. and visual evaluation by a checkers test (crosscut test) stipulated in JIS (Japanese Industrial Standards). In the column of the crosscut test, ○ marks indicate no peel-off of the plated film and x marks indicate entire peel-off of the plated film.

The results are shown in Tables 12 and 13 below. It will be found from these Tables that the plated layers according to the present invention exhibits an extremely high degree of corrosion resistance against all types of corrosion resistance tests.

TABLE 1

| Sample No. | Damp Resistance Test (80° C., 90% RH) | Salt Spray Test (30° C., 5% NaCl) |
|---|---|---|
| Example of the Invention | | |
| 1 | Spot rust locally commenced in 800 hr | Rust commenced after 80 hr |
| 2 | No change for 1000 hr | No rust for 100 hr |
| 3 | No change for 1000 hr | No rust for 100 hr |
| 4 | Spot rust locally commenced in 800 hr | Rust commenced after 80 hr |
| 5 | No change for 1000 hr | No rust for 100 hr |
| 6 | No change for 1000 hr | No rust for 100 hr |
| 7 | No change for 1000 hr | No rust for 100 hr |
| 8 | No change for 1000 hr | No rust for 100 hr |
| 9 | No change for 1000 hr | No rust for 100 hr |

TABLE 12-1

| Sample No. | Steam Press Test | Cross-cut test | Adhesion Strength Test (kgf/cm$^2$) |
|---|---|---|---|
| Example of the Invention | | | |
| 1 | No peel-off for 100 hr | ○ | 700/700 |
| 2 | No peel-off for 100 hr | ○ | 700/700 |
| 3 | No peel-off for 100 hr | ○ | 700/700 |
| 4 | No peel-off for 100 hr | ○ | 700/700 |
| 5 | No peel-off for 100 hr | ○ | 700/700 |
| 6 | No peel-off for 100 hr | ○ | 700/700 |
| 7 | No peel-off for 100 hr | ○ | 700/700 |
| 8 | No peel-off for 100 hr | ○ | 700/700 |

TABLE 13-1

| Sample No. | Damp Resistance Test (80° C., 90% RH) | Salt Spray Test (35° C., 5% NaCl) |
|---|---|---|
| Comparative Example | | |
| 10 | Spot rust locally commenced in 300 hr | Rust commenced after 30 hr |
| 11 | Spot rust locally commenced in 600 hr | Rust commenced after 60 hr |
| 12 | Spot rust locally commenced in 200 hr | Rust commenced after 20 hr |
| 13 | Spot rust locally commenced in 500 hr | Rust commenced after 50 hr |
| 14 | Spot rust locally commenced in 300 hr | Rust commenced after 30 hr |
| 15 | Film entirely peeled off in 100 hr | Rust commenced after 5 hr |
| 16 | Film entirely peeled off in 100 hr | Rust commenced after 5 hr |
| 17 | Film entirely peeled off in 100 hr | Rust commenced after 5 hr |

In Tables 12 and 13, the results of the damp resistance test indicate changes in sample appearance, the results of the salt spray test indicate whether red rust has commenced or not, and further the results of the steam press test indicate whether the plated film has been peeled off or not.

It will be found from Tables 12 and 13 that the permanent magnets according to the present invention are remarkably improved in corrosion resistance as compared with the prior art magnets. Experiment 5

Similarly to Experiment 1, samples were tested under various combinations of plating conditions as shown in Table 14.

TABLE 14

| Sample No. | | Surface Treatment | Thickness of Plated Layer |
|---|---|---|---|
| Example of the Invention | 18 | a. Ni electroplating with watt bath and washing with water | Ni plating 2 μm |
| | | b. Cu electroplating with Cu pyrophosphate bath and washing with water | Cu plating 3 μm |
| | | c. Ni electroplating with watt bath and washing with water, followed by drying at 100° C. for 5 minutes | Ni plating 5 μm |
| | | d. Immersion in solution of $CrO_3$ 10 g/l at 50° C. for 5 minutes and washing with water, followed by drying at 100° C. for 5 minutes | Total 10 μm |
| | 19 | a. Ni electroplating with watt bath and washing with water | Ni plating 2 μm |

TABLE 14-continued

| Sample No. | Surface Treatment | Thickness of Plated Layer |
|---|---|---|
| | b. Cu electroplating with Cu pyrophosphate bath and washing with water | Cu plating 3 μm |
| | c. Ni electroplating with watt bath and washing with water, followed by drying at 100° C. for 5 minutes | Ni plating 5 μm |
| | d. Immersion in solution of $Na_2Cr_2O_7.2H_2O$ 10 g/l at 50° C. for 5 minutes and washing in water, followed by drying at 100° C. for 5 minutes | Total 10 μm |

The samples shown in Table 14 were subjected to a damp resistance test at 80° C., 90% RH for 1,000 hours, a salt spray test with 5% NaCl at 35° C. for 100 hours, a steam press test (PCT) at 119.6° C., 100% RH and 2 atoms for 100 hours, and further an adhesion strength test at the interface between the surface of the magnetic body and the plated film. The adhesion strength test was made in two ways; i.e., quantitative evaluation using a Sebastian I type adhesion tester manufactured by Quad Group Co. and visual evaluation by a checkers test (crosscut test) stipulated in JIS. In the column of the crosscut test, ○ marks indicate no peel-off of the plated film and x marks indicate entire peel-off of the plated film.

It will be found from the results shown in Table 15 that the plated layers according to the present invention exhibits an extremely high degree of corrosion resistance against all types of corrosion resistance tests.

TABLE 15-1

| Sample No. | Damp Resistance Test (80° C., 90% RH) | Salt Spray Test (35° C., 5% NaCl) |
|---|---|---|
| 18* | No change for 1000 hr | No rust for 100 hr |
| 19 | No change for 1000 hr | No rust for 100 hr |

*Example of the Invention

TABLE 15-2

| Sample No. | Steam Press Test | Cross-cut Test | Adhesion Strength Test (kgf/cm$^2$) |
|---|---|---|---|
| 18* | No peel-off for 100 hr | ○ | 700/700 |
| 19 | No peel-off for 100 hr | ○ | 700/700 |

*Example of the Invention

Experiment 6

Similarly to Experiment 5, samples were tested under various combinations of plating conditions as shown in Table 16.

TABLE 16

| Sample No. | Surface Treatment | Thickness of Plated Layer |
|---|---|---|
| Example of the Invention | | |
| 20 | | |
| a. | Ni electroplating with watt bath and washing with water | Ni plating 2 μm |
| b. | Cu electroplating with Cu pyrophosphate bath and washing with water | Cu plating 3 μm |
| c. | Ni electroplating with | Ni plating |

TABLE 16-continued

| Sample No. | Surface Treatment | Thickness of Plated Layer |
|---|---|---|
| | watt bath and washing with water, followed by drying at 100° C. for 5 minutes | 5 μm |
| d. | Immersion in solution of $CrO_3$ 10 g/l at 50° C. for 5 minutes and washing with water, followed by drying at 100° C. for 5 minutes | Total 10 μm |
| e. | Immersion in solution of NaOH 50 g/l at 50° C. for 1 minute and washing with water, followed by drying at 100° C. for 5 minutes | |
| 21 | | |
| a. | Ni electroplating with watt bath and washing with water | Ni plating 2 μm |
| b. | Cu electroplating with Cu pyrophosphate bath and washing with water | Cu plating 3 μm |
| c. | Ni electroplating with watt bath and washing with water, followed by drying at 100° C. for 5 minutes | Ni plating 5 μm |
| d. | Immersion in solution of $Na_2Cr_2O_7.2H_2O$ 10 g/l at 50° C. for 5 minutes and washing with water, followed by drying at 100° C. for 5 minutes | Total 10 μm |
| e. | Immersion in solution of KOH 50 g/l at 50° C. for 1 minute and washing with water, followed by drying at 100° C. for 5 minutes | |

The samples shown Table 16 were subjected to a corrosion resistance test at 80° C., 90% RH for 500 hours and an adhesion test based on a shear strength testing method in conformity with ASTM D-1001-64. As an adhesive, 326UV manufactured by Japan Lock Tight Co., Ltd. and hardened by being left at the room temperature for 24 hours. The tension rate during the measurement was set to 5 mm/min. The results of those tests are shown in Table 17 below. Note that the adhesion strength of the sample number 18 in Table 14 is also shown for comparison.

TABLE 17

| Sample No. | Corrosion Resistance Test (80° C., 90% RH) | Adhesion Test (ASTM D-1001-64) |
|---|---|---|
| 20* | No change for 1000 hr | 200 kg/cm$^2$ |
| 21 | No change for 1000 hr | 200 kg/cm$^2$ |
| 18 | No change for 1000 hr | 50 kg/cm$^2$ |

*Example of the Invention

It will be found from Table 17 that adhesion is improved by immersing the plated film in an alkaline solution after the chromate treatment.

As will be apparent from the above, according to the present invention, a magnet primarily consisted of one or more rare earth elements and iron can achieve a remarkable improvement in corrosion resistance that has not been sufficiently obtained by any plating in the prior art. In particular, the advantage of providing satisfactory corrosion resistance with a thin plated film without using any brightener can be said a prominent advantage which is never expectable from any conventional plating.

What is claimed is:

1. A permanent magnet of the rare-earth-element/-transition-metal system having improved corrosion resistance containing one or more of rare earth elements including yttrium and transition metals mainly comprising iron, wherein a conductive underlayer having a thickness in the range of 0.1 to 10 μm is coated on the surface of the permanent magnet, and an electroplated copper layer having a thickness in the range of 2 to 20 μm and an average crystal grain size of not larger than 0.9 μm is coated on said underlayer, wherein the conductive underlayer is any one of an electroplated nickel layer, an electroless-plated copper layer and an electroplated copper layer.

2. A permanent magnet as in claim 1, wherein the X-ray diffraction intensity of the (111) plane of the copper in said electroplated copper layer having an average crystal grain size of not larger than 0.9 μm is not less than 8 KCPS.

3. A permanent magnet as in claim 1, wherein said electroplated copper layer having an average crystal grain size of not larger than 0.9 μm has a crystal structure grown in one direction.

4. A permanent magnet as in claim 2, wherein said electroplated copper layer having an average crystal grain size of not larger than 0.9 μm has a crystal structure grown in one direction.

5. A permanent magnet of the rare-earth-element/-transition-metal system having improved corrosion resistance containing one or more of rare earth elements including yttrium and transition metals mainly comprising iron, wherein a conductive underlayer having a thickness int he range of 0.1 to 10 μm is coated on the surface of the permanent magnet, an electroplated copper layer having a thickness in the range of 2 to 20 μm and an average crystal grain size of not larger than 0.9 μm is coated on said underlayer, and a protective layer is further coated on said electroplated copper layer, wherein the conductive underlayer is any one of an electroplated nickel layer, an electroless-plated copper layer and an electroplated copper layer.

6. A permanent magnet as in claim 5, wherein said protective layer is any of an electroplated nickel layer, an electroless-plated Ni-P layer and an electroplated nickel alloy layer.

7. A permanent magnet as in claim 6, wherein the surface roughness of said protective layer is not larger than 1 μm.

8. A permanent magnet as in claim 5, wherein said protective layer is a multi-layer formed by laminating an electroplated nickel layer and a chromate layer in this order.

9. A permanent magnet as in claim 8, wherein the surface of said chromate layer is treated by immersion in an alkaline solution.

10. A permanent magnet as in claim 1, wherein said permanent magnet consists of 5 to 40 wt % of R, where R is one or more of rare earth elements including yttrium, 50 to 90 wt % of TM, where TM is a group of transition metals mainly comprising iron, and 0.2 to 8 wt % of boron.

11. A permanent magnet of the rare-earth-element/-transition-metal system having improved corrosion resistance containing one or more of rare earth elements including yttrium and transition metals mainly comprising iron, wherein said permanent magnet is a hollow permanent magnet, a conductive underlayer having a thickness in the range of 0.1 to 10 μm is coated on the surface of the hollow permanent magnet, and an electroplated copper layer having a thickness in the range of 2 to 20 μm and an average crystal grain size of not larger than 0.9 μm is coated over said underlayer, wherein the conductive underlayer is any one of an electroplated nickel layer, an electroless-plated copper layer and an electroplated copper layer.

12. A permanent magnet as in claim 11, wherein said hollow permanent magnet is in the shape of a cylinder.

13. A permanent magnet of the rare-earth-element/-transition-metal system having improved corrosion resistance containing one or more of rare-earth elements including yttrium and transition metals mainly comprising iron, wherein a conductive underlayer is coated on the surface of the permanent magnet, an electroplated copper layer having an average crystal grain size of not larger than 0.9 μm is coated on said underlayer, and a protective layer is further coated on said electroplated copper layer, wherein the protective layer is an electroplated nickel layer, and the X-ray diffraction intensity of the (111) plane of the nickel of the protective layer is not less than 4 KCPS.

14. A permanent magnet as in claim 1, wherein the conductive underlayer is any one of an electroplated nickel layer, an electroless-plated layer and an electroplated copper layer prepared from a cyanic copper bath.

15. A permanent magnet as in claim 1, wherein said electroplated copper layer having an average crystal grain size of not larger than 0.9 μm is prepared from a copper pyrophosphate bath.

16. A permanent magnet as in claim 13 wherein said underlayer, said electroplated copper layer having an average crystal grain size of not larger than 0.9 microns, and said protective layer have a thickness in a range of 0.1 to 10 microns, of 2 to 20 microns and of 2 to 20 microns, respectively.

* * * * *